United States Patent [19]

Hill et al.

[11] 4,436,233

[45] Mar. 13, 1984

[54] BABY CARRIER

[76] Inventors: James B. Hill; Sally F. Hill, both of Rte. 2, Galena, Mo. 65656

[21] Appl. No.: 335,682

[22] Filed: Dec. 30, 1981

[51] Int. Cl.[3] ..... A47D 13/02

[52] U.S. Cl. ..... 224/159; 224/258

[58] Field of Search ..... 224/158, 159, 188, 257, 224/258

[56] References Cited

U.S. PATENT DOCUMENTS

| | | | |
|---|---|---|---|
| 781,033 | 1/1905 | Sutter | 224/159 |
| 1,330,485 | 2/1920 | McGinty | 224/159 |
| 2,056,925 | 10/1936 | Kimbrough | 224/159 |
| 3,700,149 | 10/1972 | Grogan | 224/188 |
| 4,149,687 | 4/1979 | Nunemacher | 224/159 |
| 4,166,558 | 9/1979 | Schroeder | 224/158 |

FOREIGN PATENT DOCUMENTS

| | | | |
|---|---|---|---|
| 930883 | 9/1947 | France | 224/159 |
| 1560260 | 1/1980 | United Kingdom | 224/159 |

*Primary Examiner*—William Price
*Assistant Examiner*—Gary E. Elkins

[57] ABSTRACT

Apparatus for carrying an infant on and by the body of an adult comprising one piece of conformable cloth-like material having a shoulder strap attached to the upper edge thereof and a waist strap attached to the lower edge thereof whereby the cloth-like material has a J-shape configuration when placed about an infant supported thereon.

8 Claims, 5 Drawing Figures

BABY CARRIER

This invention relates to apparatus for carrying a baby and, more particularly, to baby carrying apparatus which is attached to an adult person.

Various kinds of apparatus have been heretofore devised for enabling an adult to carry an infant. Such prior apparatus has been bulky and cumbersome to use. In addition, such prior apparatus has been uncomfortable for both the adult and infant. An additional problem with some prior apparatus has been the location of the infant on the back of the adult where the adult cannot watch the infant or tend to the needs of the infant.

The present invention provides a baby carrier which is comfortable for both the adult and the infant. The carrier is constructed and arranged to locate the infant on the hip and across the waist adjacent the stomach of the adult where the adult can see and tend to the needs of the infant. The carrier consists only of a cloth seat, a waist strap and a shoulder strap which may be folded and stored in a small pouch and carried in a pocket or purse when not in use.

BRIEF DESCRIPTION OF DRAWING

A presently preferred embodiment of the invention is illustrated in the accompanying drawing in which.

DETAIL DESCRIPTION

In general, the apparatus 10 comprises a comformable seat means in the form of a piece of cloth-like material 12 having a shoulder strap means in the form of a belt member 14 sewn along the upper edge thereof and a waist strap means in the form of a belt member 16 sewn along the lower edge thereof.

Figure 1:
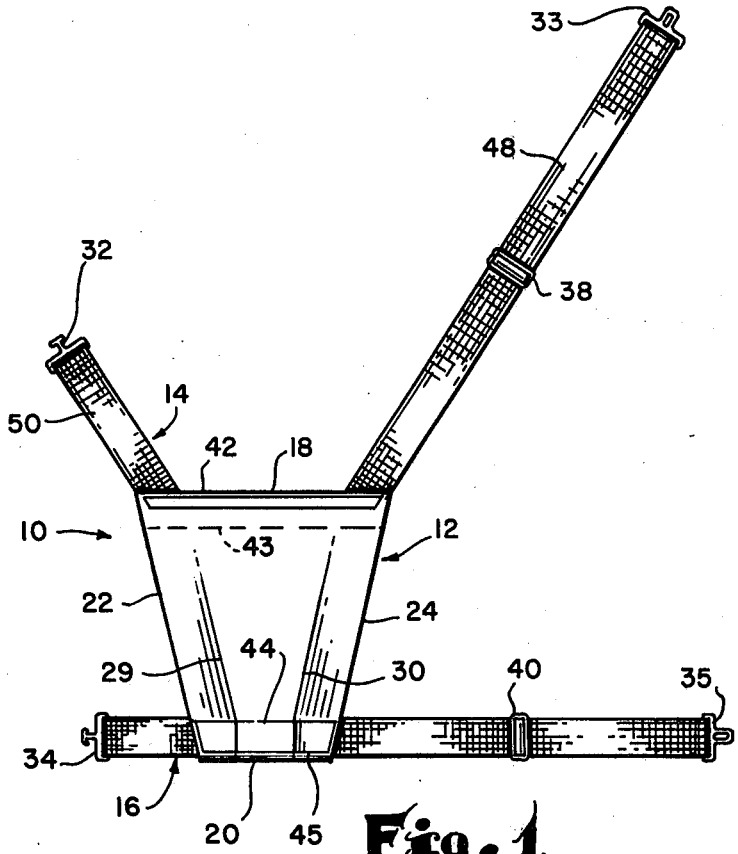
FIG. 1 is a plan view of the apparatus.
Figure 2:
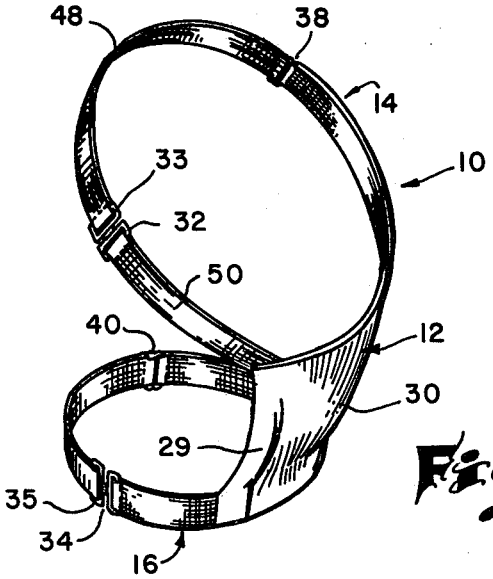
FIG. 2 is a schematic view of the apparatus as used.
Figure 3:
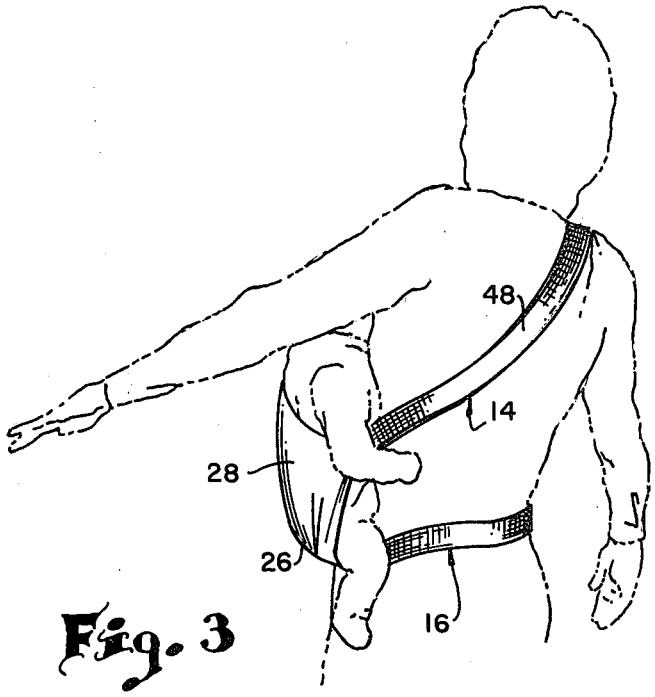
FIG. 3 is a schematic front side view of the apparatus in use.
Figure 4:
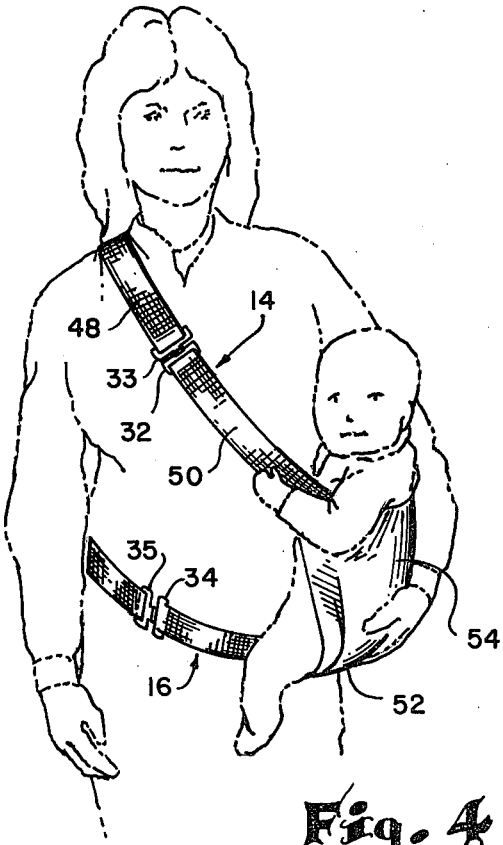
FIG. 4 is a schematic rear side view of the apparatus in use.

Seat means 12 has a trapezoidal peripheral configuration defined by a relatively long length upper edge 18, a relatively short length lower edge 20 and inclined side edges 22, 24. The length of the seat means, as measured between the upper and lower edges, and the width of the seat means, as measured between side edges 22, 24, is such as to provide a lower seat portion 26, adapted to be placed between the infant's legs and wrapped into conforming engagement with the infant's legs, crotch and buttocks, and an upper back portion 28 adapted to be wrapped around the lower portion of the infant's back as shown in FIGS. 2–4. The seat means 12 may be made of any conventional high strength flexible material such as canvas, nylon, or the like. A plurality of longitudinal pleats 29, 30 are formed in the material to enable the material to more readily conform to the infant.

Strap means 14, 16 may be made of conventional safety strap material such as used for aircraft and automotive seat belts. Each of the strap means is provided with conventional latching devices 32, 33, 34, 35 on the opposite end portions thereof and with length adjustment devices 38, 40. Mid-portions of each of the strap means are securely fastened to the seat means 12 by rows of stitching 42, 43, 44, 45. The shoulder strap means 14 has a relatively long length rear portion 48 of sufficient length to extend upwardly across the back and forwardly across the shoulder and downwardly across the chest of the adult, and a relatively short length front portion 50 of sufficient length to extend upwardly across the stomach and chest of the adult for attachment to the end of rear portion 48.

In use, the seat means is located approximately below one shoulder of the adult at waist level. When the infant is placed in the seat means, the legs of the infant straddle the hip of the adult and the infant's head is located in the vicinity of the adult's breast. The weight of the infant is supported by the waist strap means, the shoulder strap means, and the body of the adult. The bulk of the weight is supported on the hips of the adult through the waist strap. In addition, the adult can support the infant's buttock with one hand. The infant and the adult can see each other and the adult may use both hands to attend to the infant.

Figure 5:
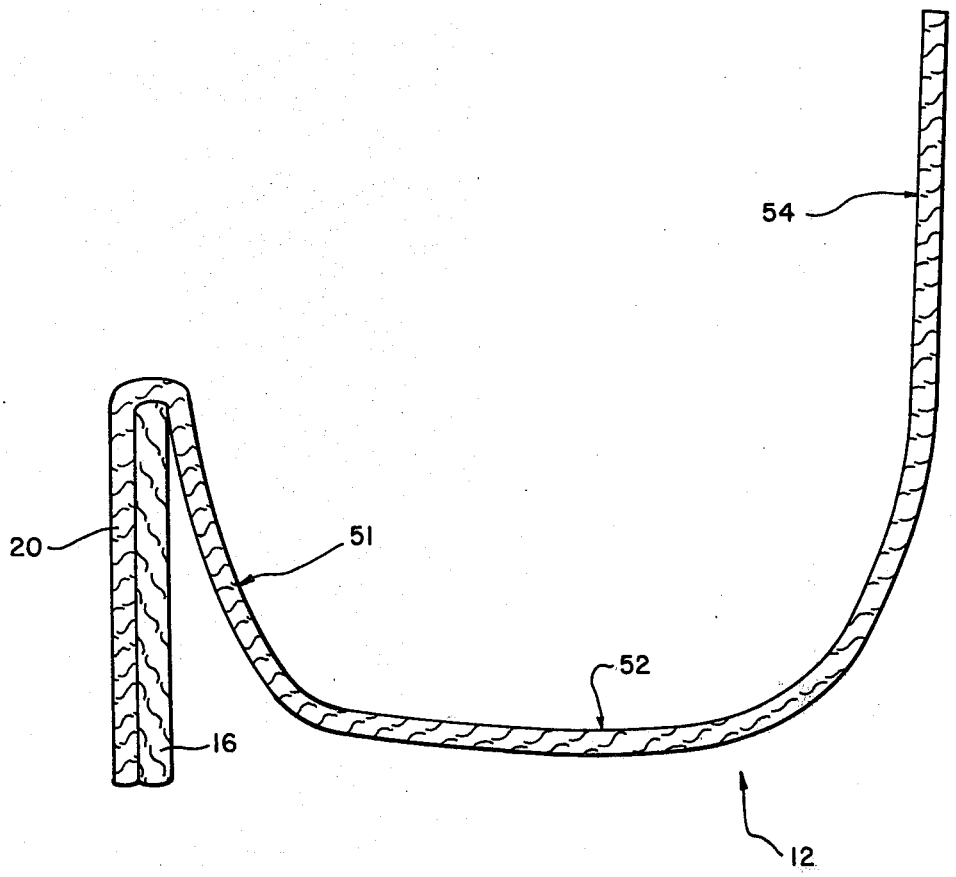
FIG. 5 is a cross section of the apparatus as used.

The construction and arrangement is such that the seat means as shown in FIG. 5 is formed into a J-shape configuration with a front flap portion 51 connected to and extending downwardly from the waist strap means and located between the adult and the infant, a bottom portion 52 located in the crotch area of the infant, and a back portion 54 extending upwardly across the back of the infant, FIG. 4. When not in use, the apparatus may be easily stored and transported because the seat means may be folded into a very small size and the strap means may be rolled up into a very small size of approximately $4\times6\times2$ inches so as to enable storage in a small bag or box of similar size which may be carried in a coat pocket or purse or the like.

While a presently preferred embodiment of the invention has been disclosed, it is intended that the appended claims be construed to include alternative embodiments except insofar as limited by the prior art.

The invention claimed is:

1. Apparatus for carrying an infant on and by the body of an adult comprising:

a seat means adapted to be located in proximity to the waist, hip and stomach of an adult for conformable supporting engagement with the legs, buttocks and lower back of the infant;

a lower hip strap means attached to a lower portion of said seat means and adapted to be located about the hips of an adult for conformable supporting engagement with the body of the adult;

an upper shoulder strap means attached to an upper portion of said seat means and adapted to be located across the back and over the shoulder and across the chest of the adult for conformable supporting engagement with the body of the adult; and said seat means and said hip strap means and said shoulder strap means being constructed and arranged to form said seat means into a J shape configuration providing a front flap portion connected to and extending downwardly from said waist strap means and located between the infant and the adult and a bottom portion located in the crotch area of the infant and a back portion extending upwardly across the back of the infant and being connected to said shoulder strap means.

2. The invention as defined in claim 1 and wherein:

said seat means being made of one piece of cloth-like material.

3. The invention as defined in claim 2 and wherein:

said seat means having a trapezoidal peripheral configuration with a relatively long length upper edge and a relatively short length lower edge and a pair of inclined side edges and providing a relatively narrow lower seat portion and a relatively wide upper back portion.

4. The invention as defined in claim 3 and wherein: said seat means having a plurality of longitudinal pleats.

5. The invention as defined in claim 3 and wherein: said shoulder strap means being fixedly attached to said seat means along said relatively long length upper edge portion thereof; and said waist strap means being fixedly attached to said seat means along said relatively short length lower edge portion thereof.

6. The invention as defined in claim 1 and wherein each of said hip strap means and said shoulder strap means comprising:

a pair of opposite end portions; and releasable latch means on said opposite end portions for releasable connection thereof.

7. The invention as defined in claim 6 and wherein each of said hip strap means and said shoulder strap means further comprising:

adjustment means for adjusting the length of said strap means.

8. The invention as defined in claim 7 and wherein each of said hip strap means and said shoulder strap means further comprising:

a single length of webbing material with a mid-portion sewn to said seat means.

* * * * *

REEXAMINATION CERTIFICATE (1189th)

United States Patent [19]

Hill et al.

[11] B1 4,436,233

[45] Certificate Issued Jan. 16, 1990

[54] BABY CARRIER

[76] Inventors: James B. Hill; Sally F. Hill, both of Rte. 2, Galena, Mo. 65656

Reexamination Request:
No. 90/001,387, Nov. 27, 1987

Reexamination Certificate for:

| | |
|---|---|
| Patent No.: | **4,436,233** |
| Issued: | **Mar. 13, 1984** |
| Appl. No.: | **335,682** |
| Filed: | **Dec. 30, 1981** |

[51] Int. Cl.[4] ..... A47D 13/02
[52] U.S. Cl. ..... 224/159; 224/258
[58] Field of Search ..... 224/158–160, 224/208, 257, 258, 259

[56] References Cited

U.S. PATENT DOCUMENTS

| | | | |
|---|---|---|---|
| D. 247,199 | 2/1978 | Carter | D87/1 A |
| D. 252,958 | 9/1979 | Tatum | D3/31 |
| D. 253,558 | 12/1979 | Carter | D3/31 |
| 522,018 | 6/1894 | Kehlenbeck | 224/159 |
| 781,033 | 1/1905 | Sutter | 224/159 |
| 1,039,009 | 9/1912 | Averill | 224/159 |
| 1,196,003 | 8/1916 | Lippincott | 224/159 |
| 1,307,597 | 6/1919 | Orloff | 224/160 |
| 1,330,485 | 2/1920 | McGinty | 224/159 |
| 1,610,805 | 12/1926 | Monro | 224/208 |
| 2,056,925 | 10/1936 | Kimbrough | 224/159 |
| 2,376,657 | 5/1945 | Chamberlain | 224/159 |
| 2,409,331 | 10/1946 | Wood | 224/159 |
| 2,599,474 | 6/1952 | Mills | 224/159 |
| 2,689,672 | 9/1954 | Thompson | 224/158 |
| 3,197,100 | 7/1965 | Thompson | 224/160 |
| 3,229,873 | 1/1966 | Hershman | 224/160 |
| 3,331,540 | 7/1967 | Higuchi | 224/160 |
| 3,481,517 | 12/1969 | Aukerman | 224/160 |
| 3,700,149 | 10/1972 | Grogan | 224/25 R |
| 3,841,543 | 10/1974 | Bolton | 224/158 |
| 3,871,562 | 3/1975 | Grenier | 224/160 |
| 4,009,808 | 3/1977 | Sharp | 224/160 |
| 4,037,764 | 7/1977 | Almonsino et al. | 224/160 |
| 4,149,687 | 4/1979 | Nunemacher | 224/159 |
| 4,166,558 | 9/1979 | Schroeder | 224/158 |
| 4,402,440 | 9/1983 | Purtzer et al. | 224/159 |
| 4,428,514 | 1/1984 | Elf | 224/160 X |

FOREIGN PATENT DOCUMENTS

| | | | |
|---|---|---|---|
| 930883 | 2/1948 | France | 224/159 |
| 1560260 | 1/1980 | United Kingdom | 224/159 |

OTHER PUBLICATIONS

"*National Geographic Society Magazine*", vol. 170, #5, 11–1986, p. 661.
"*Sunset*" Magazine, 12–1968, pp. 79 and unknown.
"*Mothers Today Source Book*" Magazine, Summer 1984, pp. 45–47.
"Baby Bundler Materials", unknown date, unknown pages.
"Super Pak Materials", unknown date, unknown pages.

*Primary Examiner*—Gary E. Elkins

[57] ABSTRACT

Apparatus for carrying an infant on and by the body of an adult comprising one piece of conformable cloth-like material having a shoulder strap attached to the upper edge thereof and a waist strap attached to the lower edge thereof whereby the cloth-like material has a J-shape configuration when placed about an infant supported thereon.

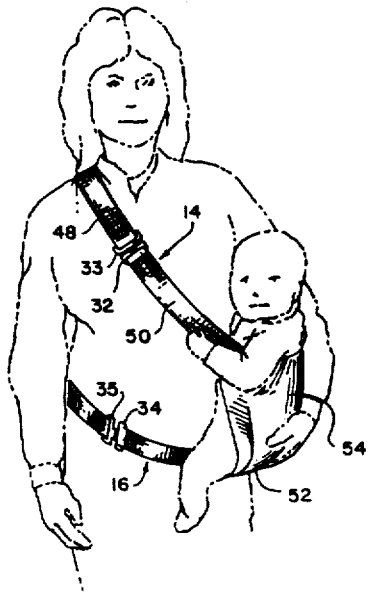

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *